United States Patent [19]

Yuhara

[11] Patent Number: 4,582,325

[45] Date of Patent: Apr. 15, 1986

[54] APPARATUS FOR DIAGNOSING THE SWING OF A CLUB, RACQUET, BAT OR SIMILAR OBJECT

[76] Inventor: Mitsuho Yuhara, No. 12-15, Kugayama 4-chome, Suginami-ku, Tokyo, Japan

[21] Appl. No.: 609,223

[22] Filed: May 11, 1984

[30] Foreign Application Priority Data

Jun. 3, 1983 [JP] Japan ..... 58-97914

[51] Int. Cl.[4] ..... A63B 69/36

[52] U.S. Cl. ..... 273/186 A; 273/183 B; 273/26 C; 434/252

[58] Field of Search ..... 273/148 B, 186 A, 186 B, 273/186 D, 183 B, 191 R, 26 R, 29 A, 26 C; 434/252

[56] References Cited

U.S. PATENT DOCUMENTS

| | | | |
|---|---|---|---|
| 2,737,432 | 3/1956 | Jenks | 434/252 |
| 3,229,059 | 1/1966 | Beatty | 273/148 B |
| 3,595,583 | 7/1971 | Oppenheimer | 434/252 |
| 3,876,212 | 4/1975 | Oppenheimer | 434/252 |
| 4,181,310 | 1/1980 | Boehmer | 273/186 A |
| 4,247,106 | 1/1981 | Jeffers et al. | 273/85 G |

OTHER PUBLICATIONS

Ciarcia, "Joystick Interfaces", *Byte,* Sep. 1979, pp. 10–18.

*Primary Examiner*—Richard C. Pinkham
*Assistant Examiner*—MaryAnn Stoll Lastova
*Attorney, Agent, or Firm*—Holman & Stern

[57] ABSTRACT

Apparatus for diagnosing the; locus of a swing, such as a golf swing, from back-swing through ball impact to follow-through by an arm pivotally mounted near the inner end in a base member attachable to a person's body and attachable at the outer end to a club shaft, the inner end being slidingly connected to crossed members rotatably mounted at their ends in the base member to operate rotatable variable resistors which produce voltage change signals which are transmitted to a computer with readout or recording device so that the loci of the swing can be observed.

6 Claims, 7 Drawing Figures

APPARATUS FOR DIAGNOSING THE SWING OF A CLUB, RACQUET, BAT OR SIMILAR OBJECT

BACKGROUND OF THE INVENTION

1. Field of the Invention

This invention relates to an apparatus for diagnosing the locus of swing of a gold club, a baseball bat, a tennis racquet, etc.

2. Description of the Prior Art

There have heretofore been various swing training machines such as golf swing training machines. However, there has been no swing diagnosing apparatus, with which the locus of swing from the back swing through ball impact to follow-through can be observed so that the swing form can be corrected accordingly.

SUMMARY OF THE INVENTION

An object of the invention is to provide an apparatus for diagnosing the swing of a golf club, a baseball bat, a tennis racquet, etc., with which the locus of a swing from back swing through ball impact to follow-through is converted by variable resistors into a voltage change signal, which is fed to a computer, for calculating swing locus data which may be displayed on a display connected to the computer or printed by a printer connected to the computer or recorded on a floppy disc and then fed to the computer again for display or printing, the swing locus data thus obtained being compared to a standard swing locus of a professional golf player or the like, thereby diagnosing the swing.

BRIEF DESCRIPTION OF THE DRAWINGS

The invention will now be described in detail with reference to the accompanying drawings wherein.

DETAILED DESCRIPTION OF THE INVENTION

Figure 1:
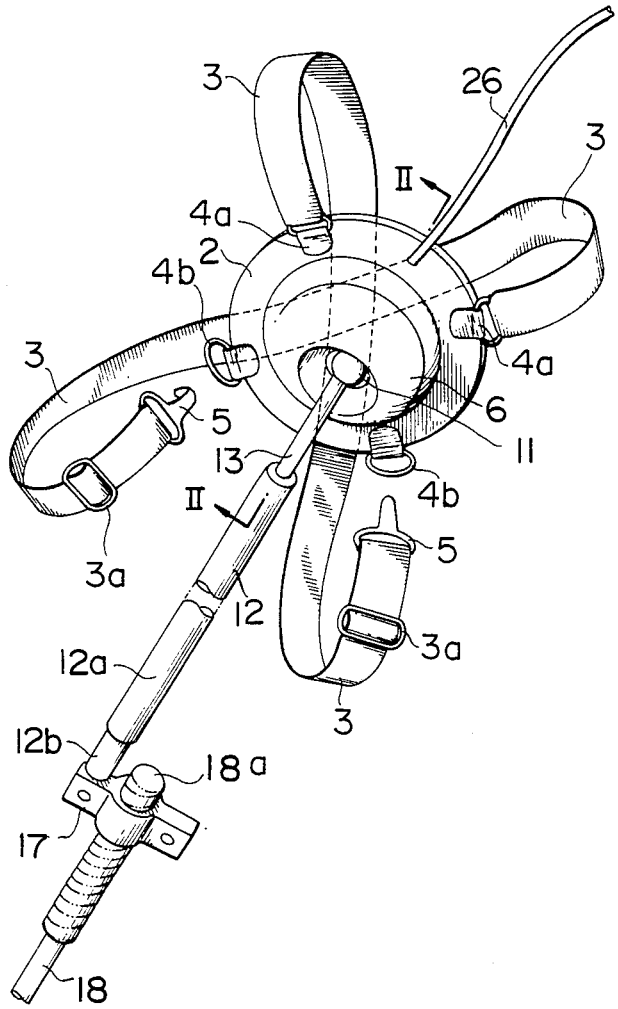
FIG. 1 is a perspective view showing a swing locus signal generator in accordance with the invention.
Figure 2:
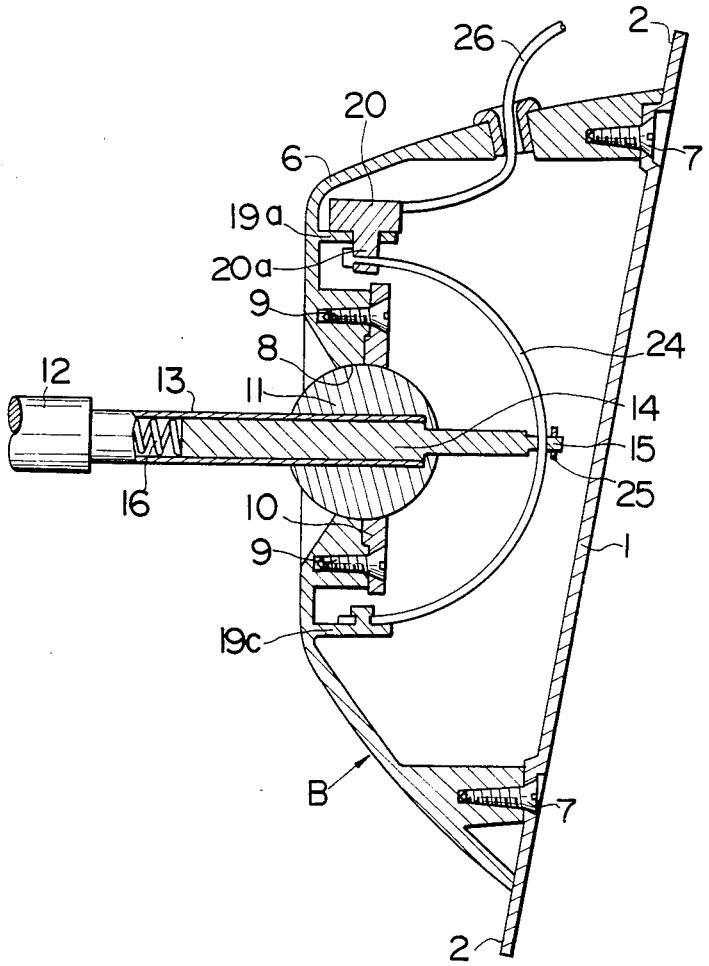
FIG. 2 is an enlarged-scale cross sectional view taken along line II—II in FIG. 1.
Figure 5:
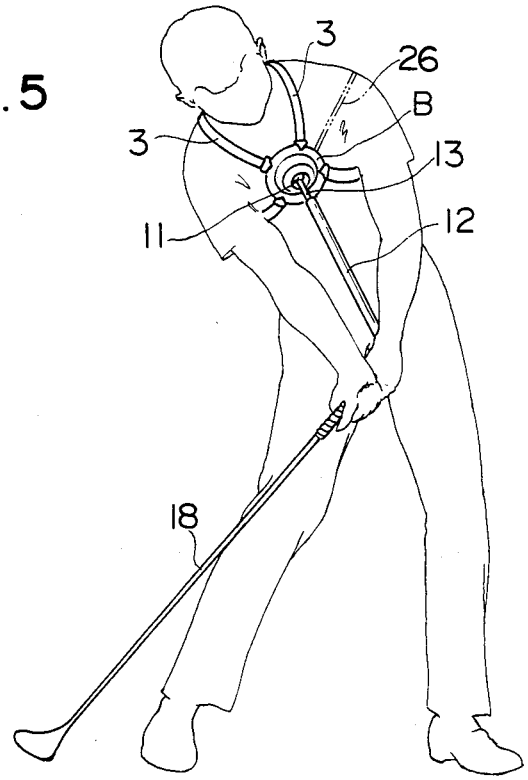
FIG. 5 is a pictorial perspective view showing the embodiment of the invention of FIG. 1 in use.
Figure 4:
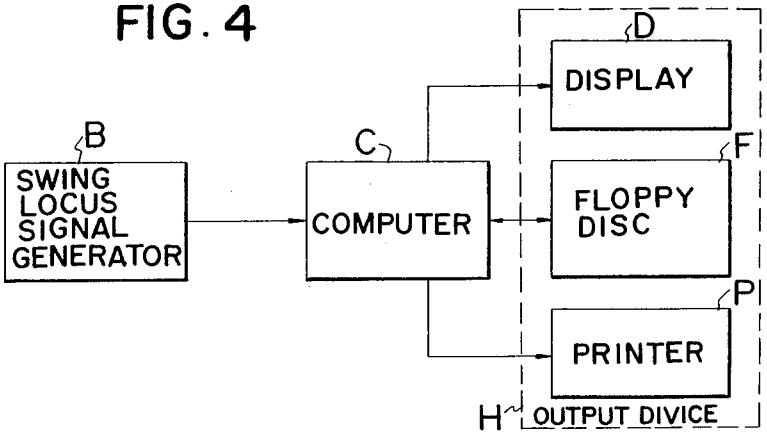
FIG. 4 is a block diagram of the embodiment of FIG. 1.

An embodiment of the invention applied to an apparatus for diagnosing the swing of a golf club will now be described with reference to FIGS. 1 through 5. Referring to FIGS. 1 and 2, reference numeral 1 designates a base plate, and two bands 3 are attached to the periphery 2 of the base plate 1. The base plate 1 can be strapped onto the chest of a man by the bands 3. Each band 3 has a buckle 3*a* which permits adjustment of the length of the band. The bands 3 are attached at one end to upper left and right portions of the periphery 2 of the base plate 1 when in use as shown in FIG. 5. They are crossed on the back of the man who wears the base plate 1, and are provided with hooks 5 at the other end. The hooks 5 are hooked on hook retainers 4*a* which are provided on lower left and right portions of the base plate periphery 2.

A cover 6 is secured by screws 7 to the base plate 1 and has a central opening 8. A reinforcement member 10 is secured by screws 9 to the inner surface of the cover 6 and has an opening which is in register with the opening 8. This opening 8 defines part of a spherical surface, in which a rotary ball 11 is rotatably surpported. A sleeve 13 extending from an arm member 12 penetrates the rotary ball 11 and is secured thereto. A guide rod 14 is inserted in the sleeve 13. The guide rod 14 has a reduced diameter end portion 15. A coil spring 16 is received in the sleeve 13 with its one end attached to the arm member 12, and biases the guide rod 14 outwardly of the sleeve 13. The arm member 12 consists of telescoped shafts 12*a* and 12*b*,and its length can be adjusted by stop means (not shown). A coupling member 17 is secured to the lower end of the shaft 12*b* of the arm member 12. A grip end 18*a* of a gold club 18 is mounted in the coupling member 17.

Figure 3:
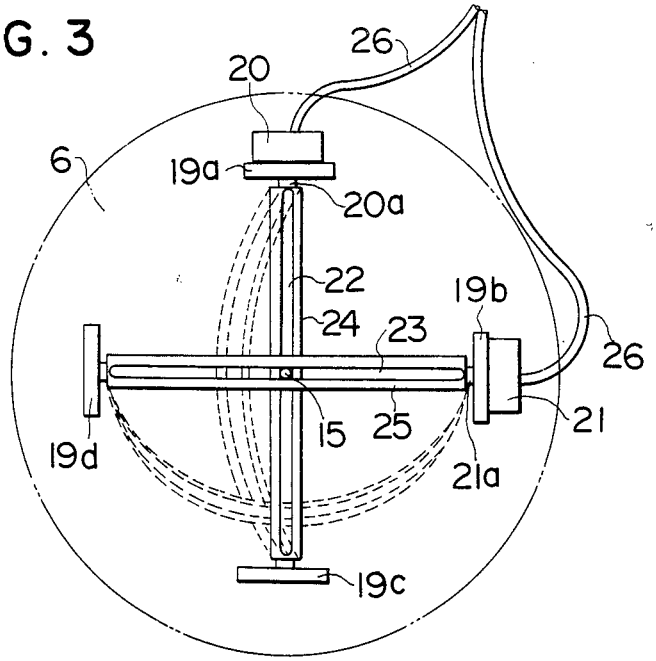
FIG. 3 is an enlarged-scale bottom plan view with parts omitted showing the essential parts of the embodiment of FIG. 1 of the invention.

The inner surface of the cover 6 has four, circumferentially spaced-apart projections 19*a* to 19*d* spaced apart at an interval of 90 degrees. As shown in FIG. 3, of the projections 19*a* to 19*d* two adjacent projections 19*a* and 19*b* support X- and Y-axis variable resistors 20 and 21 secured to them, respectively. Reference numerals 24 and 25 designate X- and Y-axis guide rails, respectively, made of a material having elasticity and mechanical strength such as a leaf spring. They have respective guide slots 22 and 23, respectively, slightly wider than the diameter of the end portion 15 of the guide rod 14. They are coupled to the base plate in an arcuately curved form and such that they cross each other at right angles to each other. More specifically, they are secured at one end to movable shafts 20*a* and 21*a* of the respective X- and Y-axis variable resistors 20 and 21 and rotatably coupled at the other end to the projections 19*c* and 19*d*, respectively, free from the X- and Y-axis variable resistors 20 and 21. The end portion 15 of the guide rod 14 loosely penetrates the guide slots 22 and 23 of the X- and Y-axis guide rails 24 and 25. The end portion 15 can be moved along the guide slots 22 and 23 with the movement of the guide rod 14. At the same time, it urges edges of the guide slots 22 and 23, so that the X-axis guide rail 24 is deflected in lateral directions with respect to the X-axis while the Y-axis guide rail 25 is deflected in vertical directions with respect to the Y-axis, as shown by dashed lines in FIG. 3. The construction described above, constitutes a swing locus signal generator B, which generates co-ordinate signals representing X- and Y-axis co-ordinates of the end portion 15 which is located at the intersection of the X- and Y-axis guide railes 24 and 25.

Cables 26 are connected at one end to the X- and Y-axis variable resistors 20 and 21, and are led to the outside of the cover 6 to be connected to a computer C. The computer C is connected to an output device H, which provides data from the swing locus signal generator B having been processed by the computer C. The output device H may be comprised of various devices depending on use, e.g., a display D, a printer P and a floppy disc F.

The operation of the invention will now be described. The base plate 1 of the swing locus signal generator B is first tightly fixed to the breast of a person's body by tightening the bands 3. Then, the grip end 18*a* of the golf club 18 is mounted in the coupling member 17 at the lower end of the arm member 12. Then, the grip end 18*a* of the golf club 18 is gripped with the hands, and the distance between the body and wrists of a commonly termed triangle defined by the arms and wrists is adjusted by adjusting the length of the arm member 12. After the preparations described above have been completed, it is now possible to exercise golf swing training as shown in FIG. 5.

With the swing locus signal generator B according to the invention, a swing of the golf club 18 causes the arm member 12 and guide rod 14 with the end portion 15 to trace corresponding loci. Thus, the end portion 15 is moved along the guide slots 22 and 23 of the X- and Y-axis guide rails 24 and 25, while it also urges the edges of the guide slots 22 and 23, causing the X-axis guide rail 24 to deflect in lateral directions while causing the Y-axis guide rail to deflect in vertical directions. Consequently, the resistances of the X- and Y-axis variable resistors 20 and 21 are varied to generate voltage change signals, which are fed to the computer C. The computer C calculates loci traced by the X- and Y-axis co-ordinates of the end portion 15 located at the intersection of the X- and Y-axis guide rails 24 and 25 and feeds the calculation data to the output device H. Where the output device H is a display D, the trace drawn by the end portion on the basis of the swing is displayed on the display D. Where the output device H is a printer P, the trace drawn by the end portion 15 is printed as a trace drawing on a sheet. Further, where the output device H is a floppy disc F, the trace of the end portion 15 is recorded on a floppy disc F. Where the output device H consists of display D and printer P, the swing trace is displayed as the trace of the end portion 15 on the display screen while it is printed on a sheet. In the case of the floppy disc F, the swing locus can be recorded on a floppy disc F, and the recorded data may be coupled, when desired, to the computer C for reproduction on the display D or printing on a sheet by the printer P. In the above way, the swing can be observed to check whether it is correct or not, and the swing form can be corrected.

Figure 7:
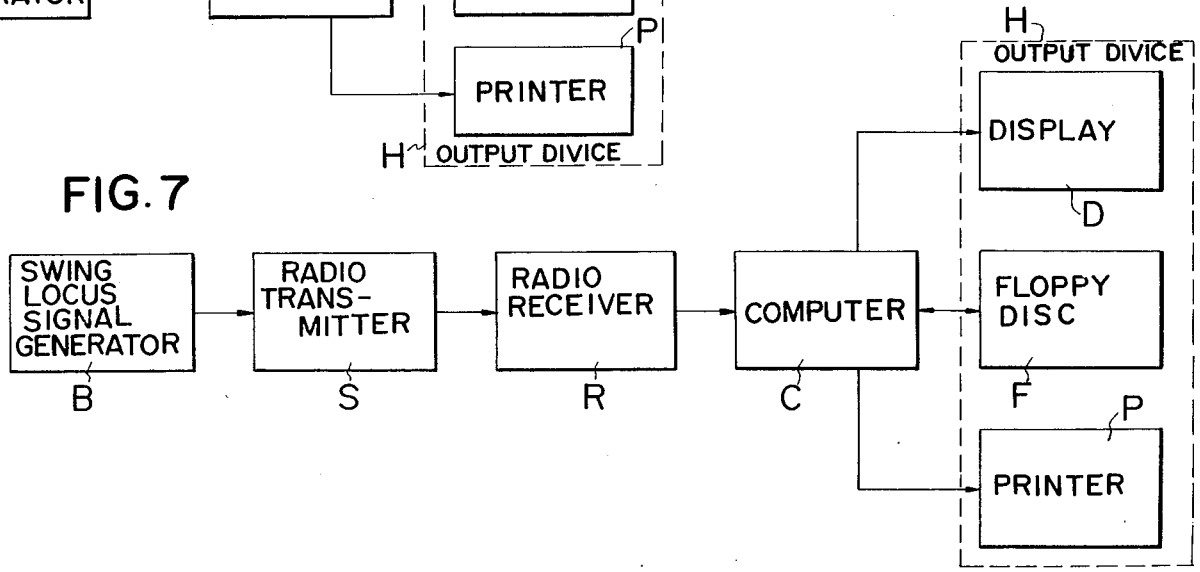
FIG. 7 is a block diagram of the second embodiment of FIG. 6.
Figure 6:
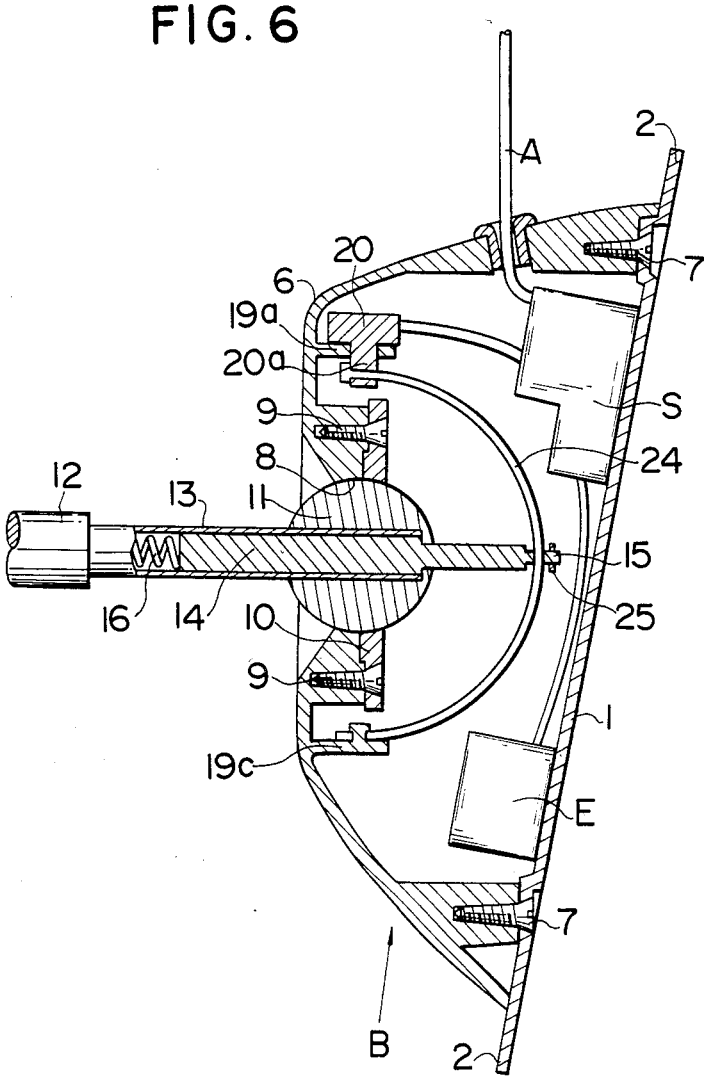
FIG. 6 is a view similar to FIG. 2 showing a second embodiment of a swing locus signal generator of the invention.

In the embodiment of FIGS. 1 through 4 described above, the voltage change signals from the X- and Y-axis variable resistors 20 and 21 are coupled via wire cables to the computer C. FIGS. 6 and 7 show a different embodiment, in which the voltage change signals are coupled to computer C via a radio system. In this embodiment, a power supply E and a radio transmitter S are mounted on the base plate 1, and X- and Y-axis variable resistors 20 and 21, respectively, are connected to the radio transmitter S. The radio transmitter S is furnished with power from the power supply E. The radio transmitter S has an antenna A, which extends through cover 6 to the outside. A radio receiver R, which receives the signal transmitted from the antenna A, is provided to feed the received signal to the computer C. The computer and output device H of this embodiment which is based on the radio system operates in the same way as the preceding embodiment, based on the wire system.

While the invention has been described in conjunction with apparatuses for diagnosing the golf club swing, the invention is also broadly applicable to swing diagnosis apparatus for diagnosing the swing of a baseball bat, tennis racquet, etc.

Therefore, by swinging the gold club 18 with the swing locus signal generator B worn strapped onto the user the swing trace data can be provided through the computer C to the output device as material with which the swing can be observed so that the swing form can be corrected.

I claim:

1. A swing diagnosing apparatus comprising:

a hollow base member formed by a substantially flat base plate and a convex shaped cover attached to said base plate;

strap means connected to said base plate for removably attaching said base member to the chest of a person;

a substantially central opening in said cover having a part spherical contour;

a spherical ball member rotatably supported in said opening;

a diametrically extending hole through said ball member;

an elongated tubular sleeve fixedly mounted at one end portion in said hole and extending outwardly of said base member therefrom;

an elongated guide rod telescopingly mounted in said sleeve and extending at one end thereof from said ball member inwardly of said cover;

a reduced diameter end portion on said one end of said guide rod;

a spring member within and attached to said sleeve and operatively engaging the other end of said guide rod to urge said guide rod inwardly of said cover;

an elongated arm member attached at one end to the other end of said sleeve;

a coupling member on the other end of said arm removably attachable to the handle portion of a golf club shaft;

two substantially semi-circular guide rails, each rotatably mounted at its ends to said cover for rotation on an axis at right angles to the axis of rotation of the other guide rail and in mutually crossing relationship with respect to each other;

a variable resistor means having a rotatable shaft and operatively mounted on said cover for rotatably supporting on said shaft one of said ends of a respective one of said guide rails;

a guide slot in each guide rail extending substantially the full length thereof and having a width slightly greater than said reduced diameter end portion of said guide rod, said reduced diameter end portion being inserted through said guide slots and being in sliding engagement therein, so that when said base member is strapped to a person a swing of the club causes said reduced end portion to slide in and rotate said guide rails about their ends to trace a locus representing X-axis and Y-axis co-ordinates with respect to a plane containing said right angle axes of rotation of said guide rails and said variable resistors produce corresponding output signals representing the X-axis and Y-axis co-ordinates;

a computer means operatively associated with said variable resistors to receive said output signals and calculate swing data therefrom representing said co-ordinates; and an output device operatively connected to said computer to receive said data and produce an output useful for indicating the form of the swing.

2. The swing diagnosis apparatus as claimed in claim 1, wherein said output device comprises a display device.

3. The swing diagnosis apparatus as claimed in claim 1, wherein said output device comprises a printer.

4. The swing diagnosis apparatus as claimed in claim 1, wherein said output device comprises a floppy disc device.

5. A swing diagnosing apparatus as claimed in claim 1 wherein:

said variable resistors are coupled to said computer means by a wire cable.

6. A swing diagnosing apparatus as claimed in claim 1 wherein:

a radio transmitter and power supply therefor are mounted in said base member;

said transmitter is operatively connected to said variable resistors to receive and transmit said output signals; and said computer means further comprises means to receive said radio signals.

* * * * *